United States Patent [19]

Oprach et al.

[11] Patent Number: 4,796,359

[45] Date of Patent: Jan. 10, 1989

[54] ELECTRIC SHAVING APPARATUS WITH A PIVOTED SHEARING HEAD SYSTEM

[75] Inventors: Klaus Oprach, Schwalbach; Lühr Harms, Oberursel; Gebhard Braun, Kelkheim; Karl Trölltsch, Frankfurt am Main, all of Fed. Rep. of Germany

[73] Assignee: Braun Aktiengesellschaft, Kronberg, Fed. Rep. of Germany

[21] Appl. No.: 29,304

[22] Filed: Mar. 23, 1987

[30] Foreign Application Priority Data

Mar. 29, 1986 [DE] Fed. Rep. of Germany ..... 3610736

[51] Int. Cl.[4] ..... B26B 19/04

[52] U.S. Cl. ..... 30/43.92; 30/43.1; 30/43.3; 30/89; 30/199

[58] Field of Search ..... 30/43.1, 43.3, 43.91, 30/43.92, 45, 89, 199, 210

[56] References Cited

U.S. PATENT DOCUMENTS

| | | | |
|---|---|---|---|
| D. 232,494 | 8/1974 | van Lelyveld . | |
| 1,997,096 | 4/1935 | Andis | 30/43.1 X |
| 2,099,537 | 11/1937 | Schmitt . | |
| 2,146,712 | 2/1939 | Collins . | |
| 2,164,425 | 7/1939 | Rand, Jr. . | |
| 2,265,382 | 12/1941 | Martin | 30/43.1 |
| 2,526,153 | 11/1946 | Page . | |
| 3,279,056 | 10/1966 | Andis . | |
| 3,935,639 | 2/1976 | Terry et al. | 30/89 X |
| 4,505,036 | 3/1985 | Ochiai et al. . | |

FOREIGN PATENT DOCUMENTS

| | | |
|---|---|---|
| 0176128 | 4/1986 | European Pat. Off. . |
| 1048509 | 1/1959 | Fed. Rep. of Germany . |
| 3309221 | 10/1983 | Fed. Rep. of Germany . |
| 811207 | 4/1959 | United Kingdom . |

*Primary Examiner*—Frank T. Yost
*Assistant Examiner*—Michael D. Folkerts

[57] ABSTRACT

An electric shaving apparatus has a housing serving as a hand grip (1) with projecting support lugs (11, 12) that defines pivot axis (Z). Shearing head system (2) is movable about pivot axis (Z) and comprises a shearing head frame (3) that has at least one upper cutter (4) with arcuate extensions towards the longitudinal sides (5, 6) of the shearing head frame (3), and at least one under cutter (25, 26, 34) driven by a motor and in cooperative relation with the upper cutter (4). The shearing head system (2) is arranged to pivot about the pivot axis (Z) in such a manner that the shearing area usable for shaving will engage the skin surface and not become disengaged from the skin surface as directions of sliding movement of the shearing head system change.

16 Claims, 5 Drawing Sheets

ELECTRIC SHAVING APPARATUS WITH A PIVOTED SHEARING HEAD SYSTEM

BACKGROUND OF THE INVENTION

This invention relates to an electric shaving apparatus having a housing and a shearing head system which is adapted to pivot relative to the housing about a pivot axis and comprises a shearing head frame, a shearing plane formed by at least one upper cutter and having arcuate extensions towards the longitudinal sides of the shearing head frame, and at least one under cutter driven by a motor and in cooperative relation with the upper cutter.

U.S. Des. Pat. No. 232,494 discloses a shaving apparatus having a pivoted twin-head shearing system whose pivot axis, which is determined by the pivot radius shown, lies below the line interconnecting the transition points of the effective shearing areas of the arcuate extensions to the shearing head frame, with the result that invariably only one shearing head will remain in engagement with the skin surface whilst the other will become disengaged from the skin surface, even when the two shearing heads are specifically made to engage the skin surface, in dependence on the respective direction of movement of the shearing heads over the skin.

From U.S. Pat. No. 2,099,537 a shearing head is known which is pivotally mounted on the hand grip of a shaving apparatus and has both planar shearing surfaces extending parallel to each other. In the shearing head disclosed in U.S. Pat. No. 2,099,537, the width of the shearing plane exposed to the contact pressure extends beyond the shearing range formed by upper and under cutters. It is bounded by two rollers serving to protect the skin which are associated with the planar shearing range outside thereof and extending parallel to its longitudinal direction. As disclosed in FIG. 8 of U.S. Pat. No. 2,099,537, the shearing plane has its pivot axis on the lever line connecting the center axes of the two rollers. On account of the distance between the shearing plane and the lever line extending parallel to the shearing plane and through the pivot axis, the forces of the contact pressure acting vertically on the shearing plane and the sliding force at which the shearing plane is moved over the skin surface combine with the sliding friction to produce a torque causing the shearing plane to engage the skin surface in the one direction of movement, while causing disengagement of the shearing plane from the skin surface in the opposite direction of movement. This disengagement effect occurs positively when the shaving apparatus comes in contact with the skin surface to be shaved through one of the rollers and is then moved over the skin.

The torque causing disengagement of the shearing plane from the skin surface becomes even greater if the pivot axis of the shearing plane is disposed below the lever line connecting the center axes of the two rollers, as disclosed in FIG. 4 of U.S. Pat. No. 2,099,537. The disengagement effect of a shearing plane as described in the foregoing with reference to FIG. 8 of U.S. Pat. 2,099,537 will also occur in the device of FIG. 3 of U.S. Pat. No. 2,526,153. In this device, the shearing plane is formed by the tangent plane connecting the peripheries of the two circular shearing heads. The effective shearing area of the two arcuate extensions covers the range from the respective transition points of the shearing head frame to the arcuate extensions and their tangent points into the shearing plane. In this device, the pivot axis for the lever arm connecting the two shearing heads is below the line interconnecting the transition points of the effective shearing areas of the arcuate extensions to the shearing head frame.

From German published and examined patent application DE-AS No. 1,048,509 a shaving apparatus is known having at least two adjacent shearing heads with plane shearing surface, the heads being movably carried in a shearing head frame stationarily mounted on a hand grip, with at least one of the shearing heads being movable relative to the other in a manner enabling the shearing heads to assume automatically positions, in response to the contact pressure exerted on the skin, in which their shearing surfaces are either in the same plane or at a more or less large relative angle. Such a control of the shearing head position in dependence on the contact pressures applied is based on the understanding that the hand grip with its shearing heads is pressed against the skin surface at almost right angles, allowing only a small amount of angular freedom for the hand grip to ensure that all shearing heads are in engagement with the skin. When the rolled edges provided in the longitudinal direction are in contact with the skin, the shearing surface of this known device is excluded from such contact. The pivot axis in each of the embodiments of DE-AS No. 1,048,509 is below the line interconnecting the transition points of the effective shaving area of the arcuate extensions to the shearing head frame.

SUMMARY OF THE INVENTION

Briefly stated, the problems associated with the prior art are overcome by the discovery of a causal relationship between the location of the pivot axis and the disengagement or break-away problem existing in prior art movable head razors.

It is an object of the present invention to pivotally mount the shearing head of a shaving apparatus in such a manner that the entire shearing area usable for a shave engages the skin surface while the housing is held against the skin at typical angles, and that the shearing area or part of the usable shearing area does not become disengaged from the skin surface as the directions of sliding movement of the shearing head over the skin surface change; the entire usable shearing area is to follow the contour of the skin surface, independently of the individual contact pressures it is exposed to.

According to the present invention, this object is accomplished in a shaving apparatus of the type initially referred to by having the pivot axis Z extend through the point of intersection SP of two straight lines $T_3$, G, where $T_3$ is the common tangent to the arcuate extensions $B_1$, $B_2$, G is a straight line intersecting the tangent $T_3$ at right angles in the center of the distance A, and A is the distance between the tangent points $TP_1$, $TP_2$ of the tangent $T_3$ to the arcuate extensions $B_1$, $B_2$.

It is a particular advantage of this balanced mounting of the shearing head system that the individual contact pressures exerted through the hand grip of the shaving apparatus are distributed evenly over the effective shearing plane following engagement of the shearing plane with the skin surface.

In a device of the type initially referred to, this object is accomplished further by having the pivot axis Z extend in the neighboring range of the point of intersection SP of two straight lines $T_3$, G and by arranging the neighboring range above the connecting line V, where $T_3$ is the common tangent to the arcuate extensions $B_1$, $B_2$, G is a straight line intersecting the tangent $T_3$ at right angles in the center of the distance A, A is the distance between the tangent points $TP_1$, $TP_2$ of the tangent $T_3$ to the arcuate extensions $B_1$, $B_2$, and V is the connecting line between the lower limit points $P_1$, $P_2$ of area of the arcuate extensions $B_1$, $B_2$, which points are remote from the tangent points $TP_1$, $TP_2$.

Each of the two solutions set out in the foregoing ensures that, within typical angles at which the shearing head of a shaving apparatus is usually held against the skin surface, the optimum shearing area usable for a shave with the particular shearing head system employed is automatically moved into engagement with the skin in the form of a shearing plane and remains engaged, regardless of contact pressures acting thereon and changing directions of shearing head sliding movement over the skin surface.

In an embodiment of the invention, the pivot axis Z of the shearing head system is provided below the tangent $T_3$ on the straight line G at a distance of up to half the relative distance B of the tangent $T_3$ to the connecting line V in the region of the straight line G.

In another embodiment of the invention, the pivot axis Z of the shearing head system is provided above the tangent $T_3$ on the straight line G at a distance of up to ten times the distance B.

In a further embodiment, the pivot axis Z of the movable shearing head system may be provided at a distance from the straight line G. Displacing the pivot axis in this manner causes an unbalanced condition of the mounting of the shearing head system, involving an uneven distribution of the respective contact pressure applied over the shearing area or shearing plane divided by the pivot axis. Disengagement of the shearing area or shearing plane from the skin surface is excluded if the pivot axis is arranged within a specific distance relative to the straight line. In all embodiments of the invention, the permissible distance cannot be calculated mathematically and, accordingly, has to be determined by practical tests.

Another configuration of the last-mentioned embodiment provides for at least one spring bearing upon the shearing head system.

The shearing head frame is preferably enclosed on all sides by means of a bottom member covering it on the driving end. The space in the interior of the all-enclosed shearing head system serves advantageously as a container collecting the hair dust which accumulates in the course of one or several shaves and can be easily removed by separating the bottom member from the shearing head frame.

For the transmission of motion from the drive member to the under cutter, a drive plate is slidably mounted in the bottom member and provided with a drive groove for engagement by the drive member.

For the purpose of limiting the pivot movement of the shearing system adapted to move about the pivot axis Z, two stops F are provided on the bottom member as well as a detent cooperating with the stops, extending out of the housing and controllable by a switch.

In a particularly advantageous embodiment of the invention, the shearing head system is arranged between two support lugs provided on the housing.

The shearing head system is preferably pivotally mounted on the support lugs by means of two bearing pins or two mounting screws (FIGS. 10, 11).

In another embodiment, the shearing head system is slidably guided in grooves provided in the support lugs by means of two guiding elements (FIG. 12).

BRIEF DESCRIPTION OF THE DRAWINGS

Further advantages and details of the invention will become apparent from the subsequent description in conjunction with the drawings disclosing some preferred embodiments. Referring to the drawings.

FIG. 4 is a perspective view of a shearing head system shown in swung-out condition to provide a view of the bottom member;

DESCRIPTION OF THE PREFERRED EMBODIMENTS

Figure 1:
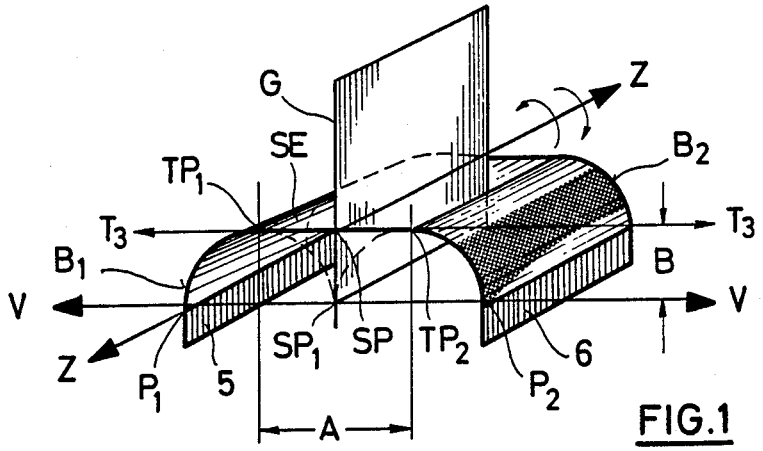
FIG. 1 is a schematic view of a shearing head system showing the shearing plane and the straight line as well as symmetrical arcuate extensions.
Figure 4:
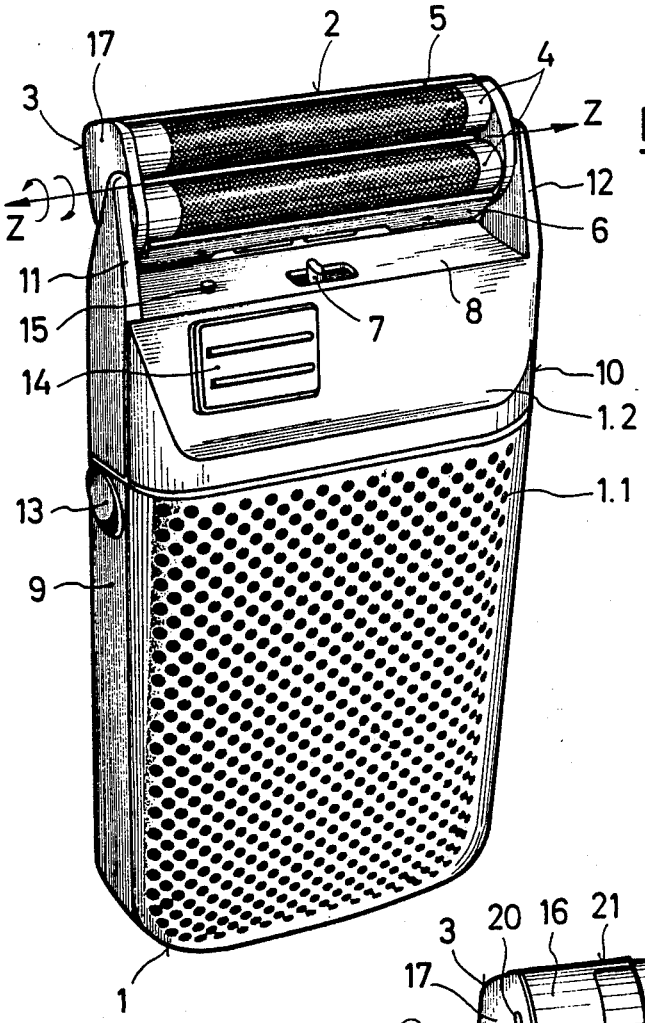
FIG. 4 is a perspective view of a shaving apparatus having a shearing system movable about the pivot axis Z.

Referring now to FIGS. 1 and 4, there is shown schematically an upper cutter 4 having arcuate extensions $B_1$ and $B_2$ towards the longitudinal sides 5 and 6 of a shearing head frame 3. In this embodiment, the arcuate extensions $B_1$ and $B_2$ are each part of the arc of a circle of identical radii. The tangent plane connecting the arcuate extensions $B_1$ and $B_2$ is an imaginary plane referred to as shearing plane SE in the following. The common tangent $T_3$ to the curved contours of the arcuate extensions B1 and B2 determines with the tangent points $TP_1$ and $TP_2$ the transition from the shearing plane SE to the arcuate extensions $B_1$ and $B_2$ on the one hand and, by the relative distance A of the tangent points $TP_1$ and $TP_2$, the width of the shearing plane SE on the other hand. The amount of longitudinal extension of the shearing plane SE parallel to the longitudinal sides 5 and 6 of the shearing head frame is dependent on the frame length provided.

The effective shearing area of the arcuate extensions $B_1$ and $B_2$ is understood to be the area in which upper and under cutters are active in the sense of shearing, or are in a position to become active in this sense because upper and under cutters are in cuttable relative engagement. In the embodiment of FIG. 1, the limit points $P_1$ and $P_2$ of the effective shearing area of the arcuate extensions $B_1$ and $B_2$, which points are on the side remote from the tangent points $TP_1$ and $TP_2$, are determined, for example, by the transition of the upper cutter 4 to the longitudinal sides 5 and 6 of the shearing head frame 3. The line interconnecting the limit points $P_1$ and $P_2$ is identified by reference character V, while the straight line intersecting both the connecting line V and the tangent $T_3$ is identified by reference character G.

The straight line G intersects the tangent $T_3$ at right angles in the center of the relative distance A of the tangent points $TP_1$ and $TP_2$. The resulting point of intersection SP serves as the preferred center of the pivot axis Z and as reference point for the neighboring range within which the pivot axis Z may also be provided. As shown, the pivot axis Z extends through the point of intersection SP as well as in the shearing plane SE and parallel to the longitudinal sides 5 and 6 of the shearing head frame in the longitudinal direction of the shearing plane SE.

Figure 2:
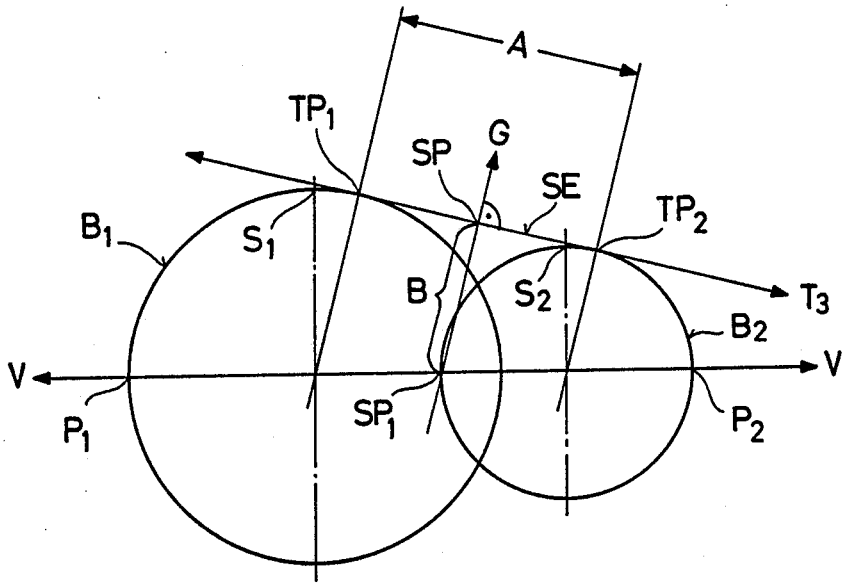
FIG. 2 is schematic view of a shearing head system showing unsymmetrical arcuate extensions.

FIG. 2 is a schematic illustration of a shearing head system in which the arcuate extensions $B_1$ and $B_2$ are unsymmetrical. In this embodiment, the arcuate extensions $B_1$ and $B_2$ are each part of the arc of a circle of different radii. The common tangent T3 to the curved contours of the arcuate extensions $B_1$ and $B_2$ determines with the tangent points $TP_1$ and $TP_2$ both the transition from the shearing plane SE to the arcuate extensions $B_1$ and $B_2$ and, by the relative distance A of the tangent points $TP_1$ and $TP_2$, the width of the shearing plane SE. In the embodiment of FIG. 2, the farthest points on the arcuate extensions $B_1$ and $B_2$ were chosen as the limit points $P_1$ and $P_2$. Accordingly, the effective shearing area of the arcuate extension $B_1$ covers the range from $P_1$ via the vertex $S_1$ of the arcuate extension up to the tangent point $TP_1$ of the tangent $T_3$ to the arcuate extension $B_1$, while the effective shearing area of the arcuate extension $B_2$ covers the range from the limit point $P_2$ up to the tangent point $TP_2$ of the tangent $T_3$ to the arcuate extension $B_2$, which point comes before the vertex $S_2$. A straight line identified as connecting line V connects the limit points $P_1$ and $P_2$. In this embodiment, the width of the shearing plane SE is determined by the relative distance A of the tangent points $TP_1$ and $TP_2$ on the tangent $T_3$. A straight line G drawn through half the distance A intersects the tangent $T_3$ at right angles in point SP. This point of intersection SP is the center of the pivot axis Z.

Figure 3:
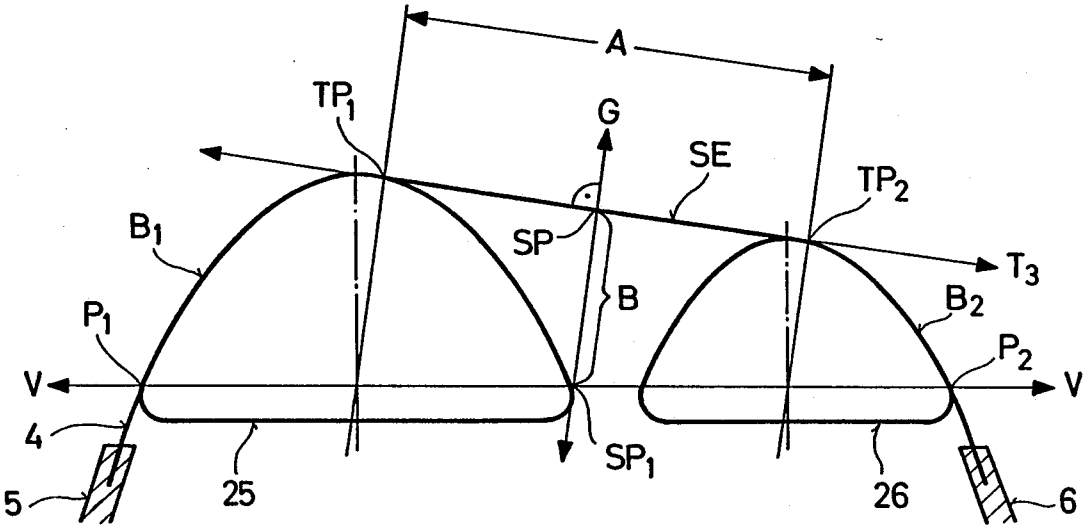
FIG. 3 is a schematic view of a shearing head system showing unsymmetrical arcuate extensions deviating from a circular form.

FIG. 3 is a schematic sectional representation of an upper cutter 4 and under cutters 25 and 26 arranged in cooperative relation with the upper cutter. The arcuate extensions $B_1$ and $B_2$ of the upper cutter 4 which are unsymmetrical and deviate from a circular form project into the longitudinal sides 5 and 6 of the shearing head frame 3 and are fastened there. In the embodiment shown, the points $P_1$ and $P_2$ limiting the effective shearing area on the curved contours of the arcuate extensions $B_1$ and $B_2$ are the lower limit points of the given area of engagement of the likewise arcuate under cutters 25 and 26 with the upper cutter 4. As becomes apparent from the illustration, the curved contours of the under cutters 25 and 26 usable for a cutting action end at points $P_1$ and $P_2$ whence they extend away from the upper cutter 4 into the interior of the shearing head frame 3. The straight line connecting the limit points $P_1$ and $P_2$ is identified as connecting line V.

The common tangent $T_3$ to the curved contours of the arcuate extensions $B_1$ and $B_2$ determines with the tangent points $TP_1$ and $TP_2$ both the transition from the shearing plane SE to the arcuate extensions $B_1$ and $B_2$ and, by the relative distance A of the tangent points $TP_1$ and $TP_2$, the width of the shearing plane SE. The effective shearing area of the arcuate extensions $B_1$ and $B_2$ covers the range from the respective tangent points $TP_1$ and $TP_2$ to the respective limit points $P_1$ and $P_2$ lying remote from the tangent points on the curved contours of the respective arcuate extensions $B_1$ and $B_2$.

The straight line G intersects the tangent $T_3$ at right angles in the center of the relative distance A of the tangent points $TP_1$ and $TP_2$. The resulting point of intersection SP is the center of the pivot axis Z of the shearing system.

Examinations of embodiments of shearing head systems movable relative to the housing and suitable for practical application revealed an excellent pivot action of the shearing head system 2 with its shearing plane SE relative to the skin surface and an excellent skin contact if the pivot axis Z is arranged to extend through the point of intersection SP.

The pivot axis Z of the movable shearing head system 2 may be provided in a neighboring range around the point of intersection SP to be determined as set forth in the embodiments of FIGS. 1 to 3, this arrangement ensuring that the entire shearing area usable for shaving is in engagement with the skin with the shaver housing held against the skin at typical angles, and that the shearing area or part of the usable shearing area does not become disengaged from the skin surface as the directions of sliding movement of the shearing head over the skin surface change. It is understood that an arrangement of the pivot axis Z in the neighborhood of the point of intersection SP requires that practical considerations be taken into account, such as the curvature of the arcuate extensions $B_1$ and $B_2$, the width of the shearing plane SE, the magnitude of the distance B between SP and $SP_1$, as well as friction and contact pressure of the shearing area SE relative to the skin surface. Therefore, the boundaries of the neighboring range as indicated in the following may be subject to restrictions in individual cases. Starting from the shearing plane SE bounded by the tangent points $TP_1$ and $TP_2$, the neighboring range extends below the shearing plane up to about half the distance B predetermined by the point of intersection SP and the point of intersection $SP_1$ of the straight line G with the connecting line V, while extending above the shearing plane up to about ten times the distance B defined in the foregoing. Because of the invariably same relative distances of the center of the pivot axis Z to the tangent points $TP_1$ and $TP_2$, providing the pivot axis Z on the straight line G intersecting the tangent $T_3$ at right angles results in a balanced bearing of the shearing head system, with the effect that the contact pressure exerted through the shaver housing is distributed evenly over the entire area of the shearing plane following engagement of the shearing plane with the skin surface.

It is also possible to provide the pivot axis Z at a relative distance to the straight line G both in the direction of the tangent point $TP_1$ and in the direction of the tangent point $TP_2$, arranging it within the shearing plane or below or above the shearing plane. In such an embodiment, an unbalanced movement of the shearing plane SE or of the shearing head frame about this pivot axis Z will occur. As a result, following engagement of the shearing plane SE with the skin surface, the contact pressure of the shaver will be distributed over the shearing plane unevenly, causing the shearing plane to engage the skin surface under uneven contact pressures. The unbalanced movement of the shearing plane SE can be compensated for by at least one spring bearing against the shearing head system. In view of the numerous influence variables to be considered including, for example, the curved contour of the arcuate extensions, the distance B between the points of intersection SP and $SP_1$ of the straight line G with the shearing plane and, respectively, the connecting line V, the friction of the upper cutter relative to the skin and the range of the contact pressures of the shaver on the skin, the limits of the permissible relative distance of the pivot axis Z to the straight FIG. 4 shows a shaving apparatus having a housing serving as hand grip 1 and a shearing head system 2 movable about a pivot axis Z and comprising a shearing head frame 3 and a shearing plane formed by a double-arched upper cutter 4 having arcuate extensions $B_1$ and $B_2$ towards the longitudinal sides 5 and 6 of the shearing head frame 3. The hand grip 1 accommodates an electric motor causing oscillation of a drive member 7 projecting out of the hand grip 1. The drive member 7 extends out of the end of the hand grip 1 referred to as the driving end 8 in the following and is adapted to be coupled either directly or indirectly to the under cutter(s) not shown in FIG. 4. Details relating to configuration possibilities and the cooperative relationships between under and upper cutters will become apparent from FIGS. 6 to 9. At the driving end 8, the sidewalls 9 and 10 of the hand grip 1 extend to form two projecting support lugs 11 and 12 providing a bearing for the pivoted shearing head frame 3.

In the shaving apparatus shown in FIG. 4, the hand grip 1 is made up of two housing assemblies 1.1 and 1.2 detachably held together by a locking mechanism operable by a locking button 13.

A switch 14 provided on the housing assembly 1.2 on the broad side of the hand grip 1 serves to operate a detent 15.

Figure 5:
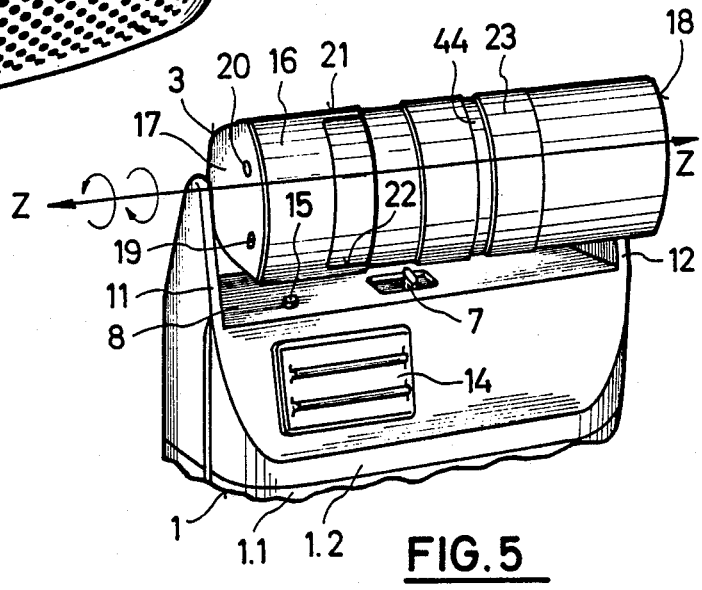

FIG. 5 illustrates the housing assembly 1.2 of the hand grip 1 of FIG. 4, with the shearing head frame 3 shown in a position making the side of the shearing head frame 3 close to the driving end 8 visible. In this embodiment, the shearing head frame 3 is provided with a bottom member 16 held between the end walls 17 and 18 of the shearing head frame 3 in a detachable, that is, removable, manner by locking means 19 and 20. For the purpose of limiting the angular movement of the shearing head system or shearing head frame 3 of FIGS. 4 and 5 movable about the pivot axis Z, two stops 21 and 22 are provided in the bottom member 16 against which the detent 15 controllable by the switch 14 abuts in the extended position, while the shearing head frame 3 is free to pivot about the pivot axis Z through 360° with the detent 15 in the retracted position.

A drive plate 23 coupled to the under cutter(s) arranged in the shearing head frame 3 is slidably mounted on the bottom member 16. The drive plate 23 has a drive groove 44 for engagement by the drive member 7 for the purpose of transmitting motion from the motor to the under cutter or cutters.

The shearing head frame 3 of FIGS. 4 and 5, in combination with the upper cutter 4 forming the shearing plane, the bottom member 16 and the under cutter(s) arranged to oscillate between the upper cutter and the bottom member, forms a shearing head system 2 enclosed on all sides and being pivotally mounted in the support lugs 11 and 12 about the pivot axis Z, with the angular movement being limitable by means of a detent 15 and abutment stops 21 and 22 such as to ensure the transmission of motion from the oscillating drive member 7 to the under cutter or cutters when the shaving apparatus is being used.

FIGS. 6 to 9 show schematically various embodiments of, and cooperative relationships between, upper cutters and under cutters in a shearing head frame 3.

Figure 6:
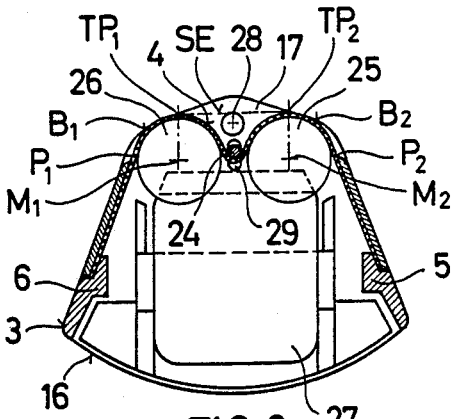
FIG. 6 is a schematic view of a shearing head system representing a section through one upper cutter, two under cutters and a shearing head frame.

FIG. 6 shows an upper cutter 4 arched over the circular contours of two under cutters 25 and 26 and secured to the longitudinal sides 5 and 6 of the shearing head frame. A guide roller 24 is arranged between the under cutters 25 and 26 such that, with the upper cutter 4 being guided around the guide roller 24, a U-shaped depression is accomplished between the two under cutters. The guide roller 24 extends parallel to the longitudinal sides 5 and 6 and is movably carried in the end walls 17 and 18 in a longitudinal guiding means 29, such as a groove, provided at right angles to the shearing plane SE when not swung out. A coupling block 27 transmitting the oscillating motion of the drive to the under cutters 25 and 26 is disposed on the bottom member 16 abutting the longitudinal sides 5 and 6. The tangent plane connecting the arcuate extensions $B_1$ and $B_2$ and bounded by the tangent points $TP_1$ and $TP_2$ and, respectively, their tangent lines extending in the longitudinal direction of the shearing head frame 3 and by the length of the upper cutter 4, is an imaginary plane referred to as shearing plane SE in the present invention. The limit points $P_1$ and $P_2$ of the effective shearing area of the arcuate extensions $B_1$ and $B_2$ on the side remote from the tangent points $TP_1$ and $TP_2$ are the points of first contact of the circumference of the under cutters 26 and 25 with the upper cutter, when viewed from the mounting ends of the upper cutter in the longitudinal sides 5 and 6 of the shearing head frame 3. A bore 28 is provided in the end wall 17 to carry the pivot axis Z. The center axis of the bore 28 is at the same time part of the pivot axis Z and lies a small amount below the shearing plane SE in the embodiment of FIG. 6. In the use of the shaver, with under cutters 25 and 26 spring-mounted on the coupling block 27 in the vertical direction, or with the coupling block 27 spring-loaded in the vertical direction, the contact pressure of the shaver against the skin surface will cause a displacement of the shearing plane SE relative to the pivot axis Z, so that the shearing plane SE will intersect the pivot axis Z horizontally at least intermittently.

Figure 7:
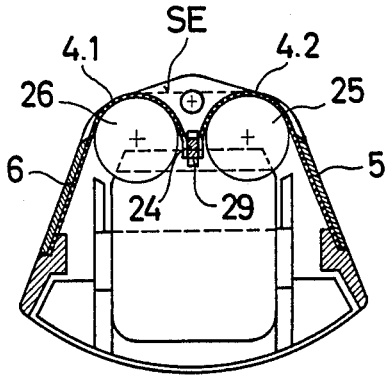
FIG. 7 is a schematic view of a shearing head system representing a section through two upper cutters, two under cutters and a shearing head frame.

Unlike the shearing head system of FIG. 6, the shearing head system of FIG. 7 shows two upper cutters 4.1 and 4.2 arched over the circular contours of two under cutters 25 and 26. Upper cutter 4.1 is secured to the longitudinal side 6 of the shearing head frame and guided around the under cutter 26 until it is in abutment with the guide roller 24 intermediate the two under cutters 25 and 26. Upper cutter 4.2 which is secured to the longitudinal side 5 is guided around the under cutter 25 until it abuts the guide roller 24. The guide roller 24 and the two upper cutters 4.1 and 4.2 are firmly connected with each other, for example, by welding or riveting. The guide roller 24 is slidably carried in the guiding means 29 as described with reference to FIG. 6.

Figure 8:
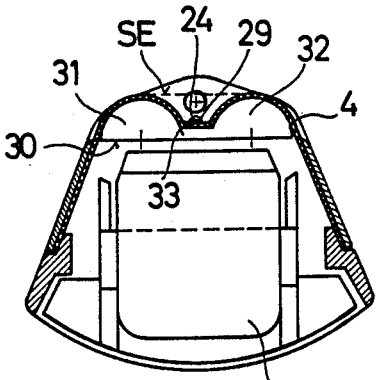
FIG. 8 is a schematic view of a shearing head system representing a section through one upper cutter, one under cutter and a shearing frame.

According to FIG. 8, the shearing head system includes one upper cutter 4 and one under cutter 30. The under cutter 30 is made up of two hemispherical cutter heads 31 and 32 connected by a bridge 33 to form a single element. The under cutter 30 is coupled to the coupling block 27 and vertically movable thereon or therewith against a spring means not shown, as described with reference to FIG. 6. The upper cutter 4 is bent around the contour of the under cutter 30 shown and is secured in the longitudinal sides 5 and 6 of the shearing head frame 3. The guide roller 24, which is slidably carried in a guiding means 29 and has the upper cutter 4 guided around it, ensures the necessary engagement of the upper cutter 4 with the under cutter or the engagement of the spring-mounted under cutter 30 with the upper cutter 4.

Figure 9:
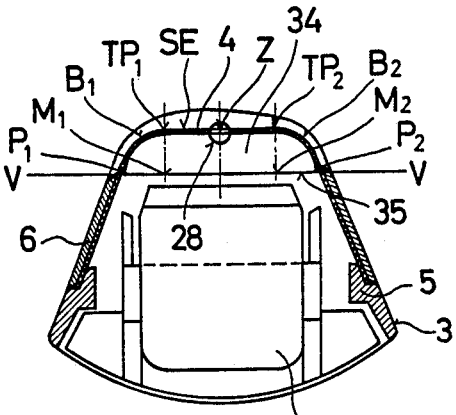
FIG. 9 is a schematic view of a shearing head system representing a section through one upper cutter, one under cutter and a shearing head frame.

FIG. 9 shows a shearing head system having an upper cutter 4 fitted over an under cutter 34. The sides extending longitudinal of the under cutter 34 are arcuate towards the longitudinal sides 5 and 6 of the shearing head frame 3 in order to form the arcuate extensions $B_1$ and $B_2$ for the overlying upper cutter 4 extending from the shearing plane SE. In this embodiment, the underside 35 of the under cutter 34 coincides with the connecting line V extending through the mid-points $M_1$ and $M_2$ and connecting the points $P_1$ and $P_2$ on the arcuate extensions $B_1$ and $B_2$. When conforming the contour of the under cutter to the shearing plane SE which connects the tangent points $TP_1$ and $TP_2$ lying vertically above the center axes of the mid-points $M_1$ and $M_2$, an under cutter results having two arcuate shearing areas and a plane seearing area in combination with the upper cutter 4 fitted over the under cutter. A bore 28 serving to receive the pivot axis Z is provided in the end wall 17. The center axis of the bore 28 which coincides with the pivot axis Z lies level with the shearing plane SE in the end wall 17. Accordingly, the pivot axis Z extends through the shearing plane. In the use of the shaver, with the under cutter 34 spring-mounted or with the coupling block 27 spring-loaded in the vertical direction, the contact pressure of the shaver against the skin surface- will cause a displacement of the shearing plane SE into the region below the pivot axis Z, which displacement amounts to the travel of the spring.

Figure 11:
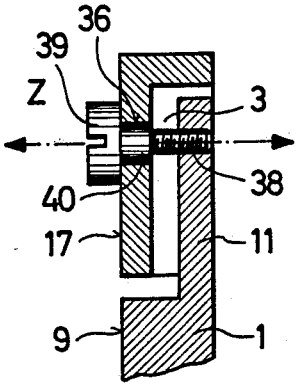
FIG. 11 is a view, in section, of a bearing configuration for the pivot axis Z on one of the support lugs and one of the end walls of the shearing head frame.
Figure 10:
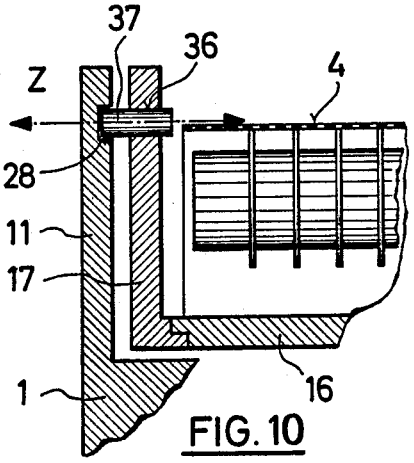
FIG. 10 is a view, in section, of a bearing configuration for the pivot axis Z on one of the support lugs and one of the end walls of the shearing head frame.

FIGS. 10 and 11 show, by way of example, two embodiments of a bearing configuration for the pivot axis Z of the shearing head system, the bearing being shown on one of the support lugs of FIG. 4. FIG. 10 shows, partly in section, the support lug 11, the end wall 17, the bottom member 16 and the upper cutter 4, as well as an under cutter. On the inside of the support lug 11, the bore 28 is provided in the manner of a blind-end hole, while a through bore 36 is provided in the end wall 17. A bearing pin 37 extending through the through bore 36 and formed fast therewith engages into the bore 28 in which it is rotatably carried. In the embodiment shown, the pivot axis Z extends through the center axes of the through bore 36 and the bore 28, lying level with the shearing plane SE of the upper cutter 4. The support lug 12 of the hand grip 1 and the end wall 18, which are not shown, are provided with a corresponding bearing configuration.

In FIG. 11, the support lug 11 is slightly offset relative to the sidewall 9 of the hand grip 1. The support lug 11 extends into the interior of the shearing head frame 3, being partially embraced by the end wall 17. A through bore 36 and a tapped hole 38 are provided in the end wall 17 and the support lug 11, respectively. A mounting screw 39 provided with a step 40 to rotatably carry the end wall 17 and thus the shearing head system extends through the through bore 36 and is screwed into the tapped hole 38. The support lug 12 of the hand grip 1 and the end wall 18, which are not shown, are provided with a corresponding bearing configuration. The pivot axis Z extends through the center axes of the through bores 36 and the tapped bores 38 of the support lugs 11 and 12.

Figure 12:
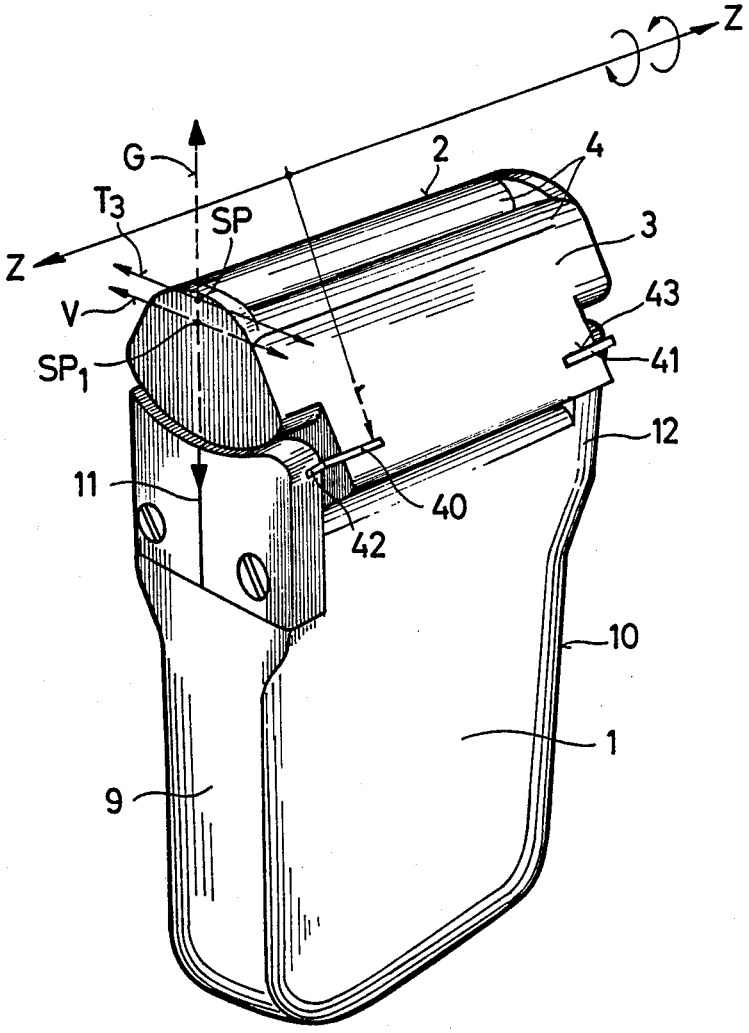
FIG. 12 is a perspective view of a shaving apparatus having its pivot axis Z above the shearing plane.

FIG. 12 shows a shaving apparatus having a housing serving as hand grip 1 and a shearing head system 2 movable about the pivot axis Z and comprising a shearing head frame 3 and a shearing plane SE formed by a double-arched upper cutter 4 with arcuate extensions $B_1$ and $B_2$ extending towards the longitudinal sides 5 and 6 of the shearing head frame 3. Extending from the sidewalls 9 and 10 of the hand grip 1, two projecting support lugs 11 and 12 are provided to movably carry the shearing head frame 3 about the pivot axis Z which lies above the shearing plane SE.

The pivot axis Z extending in the longitudinal direction of the shearing head system 2 intersects the straight line G, which in turn intersects both the shearing plane SE in point SP and the connecting line V, above the shearing plane at a distance lying with the specified neighboring range around the point of intersection SP. This range may be up to ten times the relative distance B of the points of intersection of the straight line G with the shearing plane SE on the tangent $T_3$ and the connecting line V.

The shearing head frame 3 is movably carriedby means of guiding elements 40 and 41 in grooves 42 and 43 provided in the support lugs 11 and 12, with both the guiding elements 40 and 41 and their respective grooves 42 and 43 being of an arcuate configuration corresponding to the radius R of the pivot axis Z.

While embodiments and applications of this invention have been shown and described, it will be apparent to those skilled in the art that many more modifications are possible without departing from the invention concepts herein described. The invention, therefore, is not to be restricted except as is necessary by the prior art and by the spirit of the appended claims.

What is claimed as new and desired to be secured by Letters Patent of the United States is:

1. An electric shaving apparatus having a housing, a motor in said housing, and a pivot axis located at one end of said housing, and a shearing head system mounted on said housing for pivoting movement about said pivot axis, said shearing head system comprising a shearing head frame having opposing longitudinal sides at least one upper cutter that includes two arcuate cutter extension portions extending along substantially the entire length of each longitudinal side of said shearing head frame, at least one under cutter drivingly coupled to said motor and in cooperative relation to said upper cutter, said under cutter including arcuate extension portions in cooperative relation with said arcuate cutter extension portions of said upper cutter, said shearing head frame defining a shearing plane that is tangent to both of said arcuate cutter extension portions along spaced tangent lines extending longitudinally of said shearing head frame, and said pivot axis being disposed in said shearing plane to at the center of the distance between the longitudinally extending tangent lines that define said shearing plane.

2. An electric shaving apparatus having a housing, a motor in said housing, and a pivot axis located at one end of said housing, and a shearing head system mounted on said housing for pivoting movement about said pivot axis, said shearing head system comprising a shearing head frame having opposing longitudinal sides, at least one upper cutter that includes two arcuate cutter extension portions extending along substantially the entire length of each longitudinal side of said shearing head frame, at least one under cutter drivingly coupled to said motor and in cooperative relation to said upper cutter, said under cutter including arcuate extension portions in cooperative relation with said arcuate cutter extension portions of said upper cutter, said shearing head frame defining a shearing plane that is tangent to both of said arcuate cutter extension portions along spaced tangent lines extending longitudinally of said shearing head frame, and said pivot axis being disposed in the neighboring range of the point of intersection of said shearing plane and a straight line intersecting said shearing plane at the center of the distance between the longitudinally extending tangent lines that define said shearing plane, each said arcuate cutter extension portion having a lower limit of the effective shearing area of the arcuate extension portion at a point remote from its shearing plane tangent line, said pivot axis being located on the shearing plane side of the plane defined by the lower limit points of the effective shearing areas of said arcuate cutter extension portions and extending in the neighboring range of a line of intersection of said shearing plane and a plane intersecting said shearing plane at right angles at the center of the distance between the tangent lines that define said shearing plane.

3. A shaving apparatus as claimed in claim 2 where said pivot axis is located between said shearing plane and said lower limit plane and is closer to said shearing plane than to said lower limit plane.

4. A shaving apparatus as claimed in claim 2 wherein said pivot axis is located on the side of said shearing plane remote from said lower limit plane.

5. A shaving apparatus as claimed in claim 2 wherein said pivot axis is closer to one of said arcuate cutter extension portions than to the other arcuate cutter extension portion.

6. A shaving apparatus as claimed in claim 1 or claim 2 wherein said shearing head frame includes bottom structure that fully encloses said shearing head frame on the side of said shearing head frame adjacent said housing 7. A shaving apparatus as claimed in claim 6 and further including two steps provided on said bottom structure.

8. A shaving apparatus as claimed in claim 7 and further including a detent that extends out of said housing and cooperates with said stops and is controllable by a switch.

9. A shaving apparatus as claimed in claim 6 and further including a drive plate in said shearing head frame that is coupled to said under cutter and slidably mounted on said bottom structure.

10. A shaving apparatus as claimed in claim 9 and further including a drive member carried by said housing and coupled to said motor, and wherein said drive plate includes a drive groove in driving engagement with said drive member.

11. A shaving apparatus as claimed in claim 10 and further including two stops provided on said bottom structure.

12. A shaving apparatus as claimed in claim 11 and further including a detent that extends out of said housing and cooperates with said stops and in controllable by a switch.

13. A shaving apparatus as claimed in claim 1 or claim 2 wherein said housing includes two support lugs that project from said housing and said shearing head system is supported between said support lugs.

14. A shaving apparatus as claimed in claim 13 wherein said shearing head system is pivotally mounted on said support lugs.

15. A shaving apparatus as claimed in claim 13 wherein said support lugs include arcuate grooves, and said shearing head system is slidably guided in said grooves.

16. A having apparatus as claimed in either claim 1 or 2, at least one spring is arranged to bear upon the shearing head system (2).

* * * * *

UNITED STATES PATENT AND TRADEMARK OFFICE

CERTIFICATE OF CORRECTION

PATENT NO. : 4,796,359

DATED : January 10, 1989

INVENTOR(S) : Klaus Oprach, et al.

It is certified that error appears in the above-identified patent and that said Letters Patent is hereby corrected as shown below:

Col. 3, line 6, after "of", --the effective shearing-- should be inserted;
line 60, delete "F".

Col. 4, line 21, "Fig. 4" should be --Fig. 5--.

Col. 7, line 16, after "straight", --line G can only be determined by practical tests for the individual embodiments concerned. -- should be inserted.

Col. 9, line 29, "seearing" should be --shearing--.

Col. 10, line 29, "carriedby" should be --carried by--.

Col. 10, claim 1, line 65, delete "to".

Col. 11, claim 3, line 41 "where" should be --wherein--.

Col. 12, claim 7, line 11, "steps" should be --stops--.

UNITED STATES PATENT AND TRADEMARK OFFICE

CERTIFICATE OF CORRECTION

PATENT NO. : 4,796,359

DATED : January 10, 1989

INVENTOR(S) : Klaus Oprach, et al

It is certified that error appears in the above-identified patent and that said Letters Patent is hereby corrected as shown below:

Col. 12, claim 16, line 41, "having" should read --shaving--.

Signed and Sealed this

Twenty-fourth Day of October, 1989

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,796,359

DATED : January 10, 1989

INVENTOR(S) : Klaus Oprach, et al.

It is certified that error appears in the above-identified patent and that said Letters Patent is hereby corrected as shown below:

Title page:

The following inventor was omitted from the patent:

Werner Messinger
Kronberg, Federal Republic of Germany

Signed and Sealed this

Sixteenth Day of April, 1991

*Attest:*

HARRY F. MANBECK, JR.

*Attesting Officer*

*Commissioner of Patents and Trademarks*